US011580908B2

(12) United States Patent
Jeon et al.

(10) Patent No.: US 11,580,908 B2
(45) Date of Patent: Feb. 14, 2023

(54) DRIVING CIRCUIT AND DISPLAY DEVICE

(71) Applicant: LG DISPLAY CO., LTD., Seoul (KR)

(72) Inventors: Kwanghun Jeon, Paju-si (KR); Kimin Choi, Paju-si (KR); HyoBin Choi, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/541,717

(22) Filed: Dec. 3, 2021

(65) Prior Publication Data

US 2022/0199018 A1 Jun. 23, 2022

(30) Foreign Application Priority Data

Dec. 23, 2020 (KR) ..... 10-2020-0181713

(51) Int. Cl.
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2310/08* (2013.01); *G09G 2320/0233* (2013.01); *G09G 2320/043* (2013.01); *G09G 2330/021* (2013.01)

(58) Field of Classification Search
None
See application file for complete search history.

(56) References Cited

U.S. PATENT DOCUMENTS

| | | | | |
|---|---|---|---|---|
| 10,297,192 | B2 * | 5/2019 | Lee | G09G 3/3208 |
| 10,665,174 | B2 * | 5/2020 | Park | G09G 3/3291 |
| 2014/0347332 | A1 * | 11/2014 | Lee | G09G 3/3233 345/204 |
| 2015/0130785 | A1 * | 5/2015 | Shin | G09G 5/18 345/82 |
| 2017/0193923 | A1 * | 7/2017 | Park | G09G 3/3233 |
| 2019/0385525 | A1 * | 12/2019 | Jin | G09G 3/3208 |
| 2020/0043421 | A1 * | 2/2020 | Kang | G09G 3/3275 |

* cited by examiner

*Primary Examiner* — Dorothy Harris
(74) *Attorney, Agent, or Firm* — Morgan, Lewis & Bockius LLP

(57) ABSTRACT

Embodiments of the present disclosure are related to a driving circuit and a display device, by applying an initialization voltage to a sensing node between a driving transistor and a light-emitting element and sensing a voltage change of the sensing node according to driving the light-emitting element, a threshold voltage of the light-emitting element can be detected without turning-on the driving transistor. Furthermore, by turning on the driving transistor and falling a voltage of the sensing node before sensing the voltage of the sensing node, a voltage lower than the threshold voltage of the light-emitting element can be sensed and a variation of a characteristic value of the light-emitting element is detected, thus a circuit for sensing the characteristic value of the light-emitting element can be implemented easily.

20 Claims, 13 Drawing Sheets

DRIVING CIRCUIT AND DISPLAY DEVICE

CROSS REFERENCE TO RELATED APPLICATION

This application claims priority from Korean Patent Application No. 10-2020-0181713, filed on Dec. 23, 2020, which is hereby incorporated by reference for all purposes as if fully set forth herein.

BACKGROUND

Technical Field

Embodiments of the present disclosure are related to a driving circuit and a display device.

Discussion of the Related Art

The growth of the information society leads to increased demand for display devices to display images and use of various types of display devices, such as liquid crystal display devices, organic light emitting display devices, etc.

As an organic light-emitting display device of the display devices displays an image using an organic light-emitting diode emitting a light by itself, thereby it provides advantages that a response speed is fast, a contrast ratio is good, and high color representation is possible.

The organic light-emitting display device can include the organic light-emitting diode disposed in each subpixel, and a driving transistor supplying a driving current to the organic light-emitting diode.

Circuit elements such as the organic light-emitting diode or the driving transistor disposed on the subpixel can be degenerated as a driving time of the organic light-emitting display device increases. A variation of a characteristic value between the circuit elements can occur due to a degeneration of the circuit elements disposed on the subpixel.

Due to the variation of the characteristic value between the circuit elements disposed on the subpixel, a driving of the subpixel is not controlled accurately or a driving variation between the subpixels can occur. In this case, there is a problem that an image quality displayed through a display panel can be dropped.

SUMMARY

Accordingly, embodiments of the present disclosure are directed to a driving circuit and a display device that substantially obviate one or more of the problems due to limitations and disadvantages of the related art.

An aspect of the present disclosure is to provide methods being capable of sensing a characteristic value of a circuit element disposed on a subpixel included in a display panel, and compensating a variation of the characteristic value of the circuit element disposed on the subpixel.

An aspect of the present disclosure is to provide methods being capable of implementing easily a circuit component sensing the characteristic value of the circuit element disposed on the subpixel, and improving an accuracy of a sensing.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described herein, a display device comprises a plurality of subpixels disposed in a display panel, a plurality of sensing lines electrically connected to at least one of the plurality of subpixels, and a driving circuit driving the plurality of sensing lines.

Each of the plurality of subpixels can include a light-emitting element, a driving transistor driving the light-emitting element, and a sensing transistor electrically connected between a sensing node which the light-emitting element and the driving transistor are electrically connected to each other and the sensing line.

During a sensing period for detecting a characteristic value of the light-emitting element, in a first period, the sensing transistor can become a turned-on state and an initialization voltage can be supplied through the sensing line, in a second period, a supply of the initialization voltage to the sensing line can be stopped, in a third period, the driving transistor can become a turned-on state, and in a fourth period, a sensing voltage of the sensing node can be detected.

In the third period, an auxiliary data voltage can be supplied to a gate node of the driving transistor, and the auxiliary data voltage can be smaller than the initialization voltage.

The auxiliary data voltage supplied to a subpixel where a first driving transistor is disposed among the plurality of subpixels can be different from the auxiliary data voltage supplied to a subpixel where a second driving transistor is disposed among the plurality of subpixels.

In the third period, a voltage of a driving node which the driving transistor is electrically connected to a driving voltage line can be smaller than the auxiliary data voltage.

A length of the third period can be smaller than a length of the second period.

A degree that a voltage of the sensing node is changed in the third period can be greater than a degree that a voltage the sensing node is changed in the second period.

The voltage of the sensing node can decrease in the third period.

In another aspect, a display device comprises a plurality of subpixels disposed in a display panel, a plurality of sensing lines electrically connected to at least one of the plurality of subpixels, and a driving circuit driving the plurality of sensing lines, wherein each of the plurality of subpixels comprises a light-emitting element, a driving transistor driving the light-emitting element, and a sensing transistor electrically connected between a sensing node which the light-emitting element and the driving transistor are electrically connected to each other and the sensing line, wherein, during a sensing period for detecting a characteristic value of the light-emitting element, an initialization voltage is supplied to the sensing node and a sensing voltage of the sensing node is detected after a predetermined period, and the driving transistor is a turned-off state in at least a part period of the sensing period.

The driving transistor can become a turned-on state in a part period of the predetermined period. And the driving transistor can become a turned-off state before the sensing voltage of the sensing node is detected.

The light-emitting element can be a turned-off state in a period that the driving transistor is a turned-on state.

In another aspect, a driving circuit comprises a first voltage output portion controlling a voltage output to a data line electrically connected to a subpixel, a second voltage output portion controlling a voltage output to a sensing line electrically connected to the subpixel, and a sensing portion electrically connected to the sensing line.

During a sensing period for detecting a characteristic value of a light-emitting element disposed on the subpixel, in a first period, the first voltage output portion outputs a sensing data voltage to the data line and the second voltage output portion outputs an initialization voltage to the sensing line, in a second period, the second voltage output portion stops an output of the initialization voltage, in a third period, the first voltage output portion outputs an auxiliary data voltage greater than the sensing data voltage and smaller than the initialization voltage to the data line, and in a fourth period, the sensing portion detects a sensing voltage through the sensing line.

According to various embodiments of the present disclosure, as applying directly an initialization voltage to a sensing node between a driving transistor and a light-emitting element disposed on a subpixel and detecting a voltage change of the sensing node, a characteristic value of the light-emitting element can be sensed in various structures of the subpixel.

According to various embodiments of the present disclosure, by turning-on the driving transistor and falling a voltage of the sensing node before detecting a voltage of the sensing node, a voltage lower than a threshold voltage of the light-emitting element can be sensed, thus a circuit detecting the characteristic value of the subpixel can be implemented easily.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain various principles. In the drawings.

DETAILED DESCRIPTION

Figure 1:
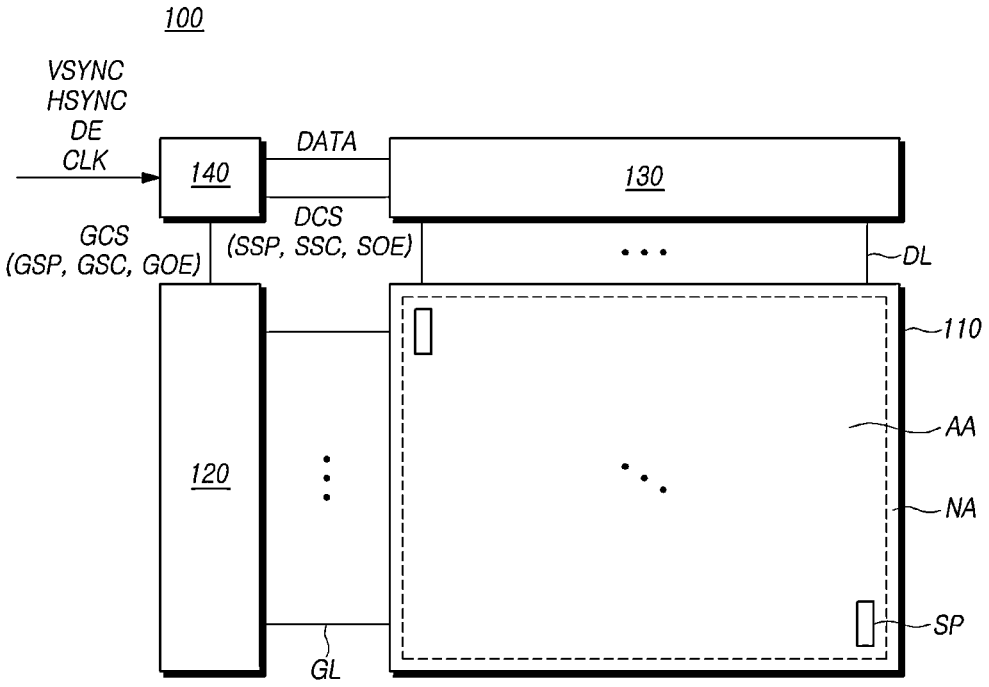
FIG. 1 is a diagram schematically illustrating a configuration of a display device according to embodiments of the present disclosure.

In the following description of examples or embodiments of the present disclosure, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the present disclosure, detailed descriptions of well-known functions and components incorporated herein will be omitted when it is determined that the description may make the subject matter in some embodiments of the present disclosure rather unclear. The terms such as "including", "having", "containing", "constituting" "make up of", and "formed of" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" may be used herein to describe elements of the present disclosure. Each of these terms is not used to define essence, order, sequence, or number of elements etc., but is used merely to distinguish the corresponding element from other elements.

When it is mentioned that a first element "is connected or coupled to", "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to", "contact or overlap", etc. each other via a fourth element. Here, the second element may be included in at least one of two or more elements that "are connected or coupled to", "contact or overlap", etc. each other.

When time relative terms, such as "after," "subsequent to," "next," "before," and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified. Further, the term "may" fully encompasses all the meanings of the term "can".

FIG. 1 is a diagram schematically illustrating a configuration included in a display device 100 according to embodiments of the present disclosure. All the components of the display device 100 according to all embodiments of the present disclosure are operatively coupled and configured.

Referring to FIG. 1, the display device 100 can include a display panel 110, and a gate driving circuit 120, a data driving circuit 130 and a controller 140 for driving the display panel 110.

The display panel 110 can include an active area AA where a plurality of subpixels SP is disposed, and a non-active area which is located outside the active area AA.

A plurality of gate lines GL and a plurality of data lines DL can be arranged on the display panel 110. The plurality of subpixels SP can be located in areas where the gate lines GL and the data lines DL intersect each other.

The gate driving circuit 120 is controlled by the controller 140, and sequentially outputs scan signals to the plurality of gate lines GL arranged on the display panel 110, thereby controlling the driving timing of the plurality of subpixels SP.

The gate driving circuit 120 can include one or more gate driver integrated circuits GDIC, and can be located only at one side of the display panel 110, or can be located at both sides thereof according to a driving method.

Each gate driver integrated circuit GDIC can be connected to a bonding pad of the display panel 110 by a tape automated bonding TAB method or a chip-on-glass COG method, or can be implemented by a gate-in-panel GIP method to then be directly arranged on the display panel 110. In some cases, the gate driver integrated circuit GDIC can be integrated and arranged on the display panel 110. Alternatively, each gate driver integrated circuit GDIC can be implemented by a chip-on-film COF method in which an element is mounted on a film connected to the display panel 110. Alternatively, each gate driver integrated circuit GDIC can be located on an area overlapped with the active area AA of the display panel 110.

The data driving circuit 130 receives image data from the controller 140 and converts the image data into an analog data voltage Vdata. Then, the data driving circuit 130 outputs the data voltage Vdata to each data line DL according to the timing at which the scan signal is applied through the gate line GL so that each of the plurality of subpixels SP emits light having brightness according to the image data.

The data driving circuit 130 can include one or more source driver integrated circuits SDIC.

Each source driver integrated circuit SDIC can include a shift register, a latch circuit, a digital-to-analog converter, an output buffer, and the like.

Each source driver integrated circuit SDIC can be connected to a bonding pad of the display panel 110 by a tape automated bonding TAB method or a chip-on-glass COG method, or can be directly disposed on the display panel 110. Alternatively, in some cases, the source driver integrated circuit SDIC can be integrated and arranged on the display panel 110. Alternatively, each source driver integrated circuit SDIC can be implemented by a chip-on-film COF method. In this case, each source driver integrated circuit SDIC can be mounted on a film connected to the display panel 110, and can be electrically connected to the display panel 110 through wires on the film.

The controller 140 supplies various control signals to the gate driving circuit 120 and the data driving circuit 130, and controls the operation of the gate driving circuit 120 and the data driving circuit 130.

The controller 140 can be mounted on a printed circuit board, a flexible printed circuit, or the like, and can be electrically connected to the gate driving circuit 120 and the data driving circuit 130 through the printed circuit board, the flexible printed circuit, or the like.

The controller 140 can allow the gate driving circuit 120 to output a scan signal according to the timing implemented in each frame. The controller 140 can convert a data signal received from the outside to conform to the data signal format used in the data driving circuit 130 and then output the converted image data to the data driving circuit 130.

The controller 140 receives, from the outside (e.g., a host system), various timing signals including a vertical synchronization signal VSYNC, a horizontal synchronization signal HSYNC, an input data enable DE signal, a clock signal CLK, and the like, as well as the image data.

The controller 140 can generate various control signals using various timing signals received from the outside, and can output the control signals to the gate driving circuit 120 and the data driving circuit 130.

For example, in order to control the gate driving circuit 120, the controller 140 can output various gate control signals GCS including a gate start pulse GSP, a gate shift clock GSC, a gate output enable signal GOE, or the like.

The gate start pulse GSP controls operation start timing of one or more gate driver integrated circuits GDIC constituting the gate driving circuit 120. The gate shift clock GSC, which is a clock signal commonly input to one or more gate driver integrated circuits GDIC, controls the shift timing of a scan signal. The gate output enable signal GOE specifies timing information on one or more gate driver integrated circuits GDIC.

In addition, in order to control the data driving circuit 130, the controller 140 can output various data control signals DCS including a source start pulse SSP, a source sampling clock SSC, a source output enable signal SOE, or the like.

The source start pulse SSP controls a data sampling start timing of one or more source driver integrated circuits SDIC constituting the data driving circuit 130. The source sampling clock SSC is a clock signal for controlling the timing of sampling data in the respective source driver integrated circuits SDIC. The source output enable signal SOE controls the output timing of the data driving circuit 130.

The display device 100 can further include a power management integrated circuit for supplying various voltages or currents to the display panel 110, the gate driving circuit 120, the data driving circuit 130, and the like or controlling various voltages or currents to be supplied thereto.

Each of the plurality of subpixels SP can be an area defined by the intersection of the gate line GL and the data line DL, and at least one circuit element including an element emitting a light can be disposed on the subpixel SP.

For example, in the case that the display device 100 is an organic light-emitting display device, an organic light-emitting diode OLED and a plurality of circuit elements can be disposed in each of the plurality of subpixels SP. As the display device 100 drives the plurality of circuit elements to control a current supplying to the organic light-emitting diode OLED disposed on the subpixel SP, and can control that each subpixel SP represents a luminance corresponding to the image data.

Furthermore, in some cases, different type of element from the organic light-emitting diode OLED can be disposed on the subpixel SP and can emit a light.

Figure 2:
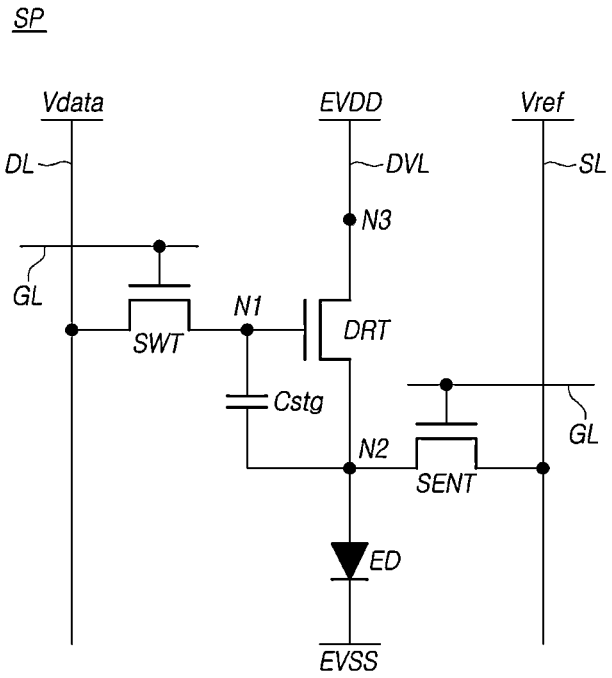
FIG. 2 is a diagram illustrating an example of a circuit structure of a subpixel included in a display device according to embodiments of the present disclosure.

FIG. 2 is a diagram illustrating an example of a circuit structure of the subpixel SP included in the display device 100 according to embodiments of the present disclosure.

FIG. 2 illustrates the example of the circuit structure of the subpixel SP in the case that the display device 100 is the organic light-emitting display device, but embodiments of the present disclosure can be applied to different types of display devices.

Referring to FIG. 2, a light-emitting element ED and a driving transistor DRT for driving the light-emitting element ED can be disposed on the subpixel SP. Furthermore, at least one circuit element other than the light-emitting element ED and the driving transistor DRT can be further disposed on the subpixel SP.

For example, such as the example illustrated in FIG. 2, a switching transistor SWT, a sensing transistor SENT and a storage capacitor Cstg can be further disposed on the subpixel SP.

Thus, the example illustrated in FIG. 2, illustrates a 3T1C structure that three thin film transistors and one capacitor are disposed other than the light-emitting element ED on the subpixel SP as an example, but embodiments of the present disclosure aren't limited to this. Furthermore, the example illustrated in FIG. 2, illustrates a case that all of the thin film transistors are N types as an example, but in some cases, the thin film transistors disposed on the subpixel SP can be P types.

The switching transistor SWT can be electrically connected between the data line DL and a first node N1.

The data voltage Vdata can be supplied to the subpixel SP through the data line DL. The first node N1 can be a gate node of the driving transistor DRT.

The switching transistor SWT can be controlled by the scan signal supplied to the gate line GL. The switching transistor SWT can control that the data voltage Vdata supplied through the data line DL is applied to the gate node of the driving transistor DRT.

The driving transistor DRT can be electrically connected between a driving voltage line DVL and the light-emitting element ED.

A first driving voltage EVDD can be supplied to a third node N3 through the driving voltage line DVL. The first driving voltage EVDD, for example, can be a high potential voltage. The third node N3 can be a drain node or a source node of the driving transistor DRT.

The driving transistor DRT can be controlled by a voltage applied to the first node N1. And the driving transistor DRT can control a driving current supplied to the light-emitting element ED.

The sensing transistor SENT can be electrically connected between a sensing line SL and a second node N2.

A reference voltage Vref can be supplied to the second node N2 through the sensing line SL. The second node N2 can be the source node or the drain node of the driving transistor DRT.

The sensing transistor SENT can be controlled by the scan signal supplied to the gate line GL. The gate line GL controlling the sensing transistor SENT can be different from the gate line GL controlling the switching transistor SWT.

Alternatively, the gate line GL controlling the sensing transistor SENT can be same as the gate line GL controlling the switching transistor SWT.

As the switching transistor SWT and the sensing transistor SENT are controlled by same gate line GL, the number of the gate line GL disposed on the subpixel SP can be reduced and an aperture ratio of the subpixel SP can be increased.

The sensing transistor SENT can control that the reference voltage Vref is applied to the second node N2. Furthermore, the sensing transistor SENT, in some cases, can control to sense a voltage of the second node N2 through the sensing line SL.

The storage capacitor Cstg can be electrically connected between the first node N1 and the second node N2. The storage capacitor Cstg can maintain the data voltage Vdata applied to the first node N1 during one frame.

The light-emitting element ED can be electrically connected between the second node N2 and a line supplied with a second driving voltage EVSS. The second driving voltage EVSS, for example, can be a low potential voltage.

When the scan signal of a turned-on level is applied to the gate line GL, the switching transistor SWT and the sensing transistor SENT can be turned-on. The data voltage Vdata can be applied to the first node N1, and the reference voltage Vref can be applied to the second node N2.

The driving current supplied by the driving transistor DRT can be determined according to a difference between a voltage of the first node N1 and a voltage of the second node N2.

The light-emitting element ED can represent a luminance according to the driving current supplied through the driving transistor DRT.

It is necessary to maintain a characteristic value (e.g., a threshold voltage) of the light-emitting element ED disposed on the each subpixel SP uniformly so that the light-emitting element ED represents a constant luminance according to the driving current supplied to the light-emitting element ED.

But a uniform luminance may not be represented due to variation of the characteristic values between the light-emitting elements ED disposed on the subpixels SP.

Furthermore, a degeneration of the light-emitting element ED can be progressed according to increasing a driving time of the light-emitting element ED. The variation of the characteristic values between the light-emitting elements ED can become much greater due to the degeneration of the light-emitting element ED.

The display device 100 according to the embodiments of the present disclosure provides methods capable of improving uniformity of the luminance that the display panel 110 represents by detecting the characteristic value of the light-emitting element ED disposed on the subpixel SP easily and compensating the variation of the characteristic value of the light-emitting element ED.

Figure 3:
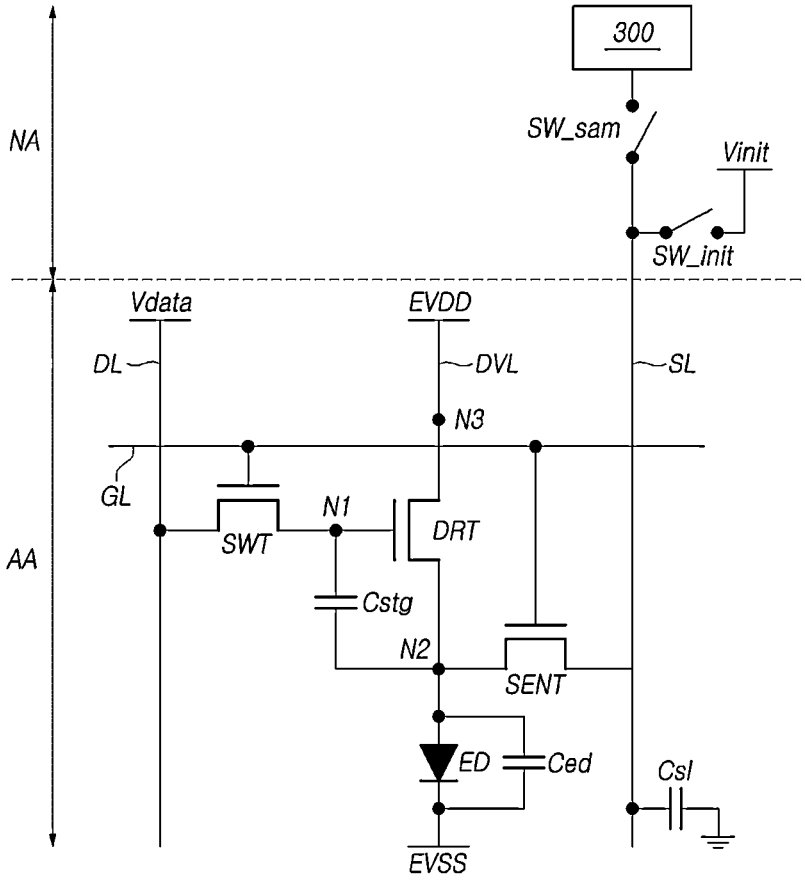
FIG. 3 is a diagram illustrating an example of a structure sensing a characteristic value of a subpixel included in a display device according to embodiments of the present disclosure.

FIG. 3 is a diagram illustrating an example of a structure sensing a characteristic value of the subpixel SP included in the display device 100 according to embodiments of the present disclosure.

Referring to FIG. 3, the display device 100 can include a sensing portion 300 capable of sensing the characteristic value of the subpixel SP.

In the present disclosure, the characteristic value of the subpixel SP can mean the characteristic value of the circuit element disposed on the subpixel SP.

For example, the characteristic value of the subpixel SP can mean a threshold voltage or a mobility of the driving transistor DRT. Alternatively, the characteristic value of the subpixel SP can mean a threshold voltage of the light-emitting element ED.

Examples described below are examples sensing the threshold voltage of the light-emitting element ED, but embodiments of the present disclosure aren't limited to this.

The sensing portion 300 can be electrically connected to the sensing line SL electrically connected to the subpixel SP.

The sensing portion 300 can be included in a driving circuit disposed on the non-active area NA of the display panel 110. For example, the sensing portion 300 can be included in the data driving circuit 130. Examples described below are examples that the sensing portion 300 is included in the data driving circuit 130, but in some cases, the sensing portion 300 can be included in a circuit disposed separated from the data driving circuit 130.

In the case that the sensing portion 300 is included in the data driving circuit 130, the data driving circuit 130 can include a first voltage output portion (not illustrated) controlling a voltage supplied to the data line DL for the sensing.

Furthermore, the data driving circuit 130 can include a second voltage output portion (not illustrated) controlling a voltage supplied to the sensing line SL for the sensing. A voltage output by the second voltage output portion, for example, can be an initialization voltage Vinit. A supply source of the initialization voltage Vinit can be electrically connected to the sensing line SL by an initialization voltage control switch SW_init.

The sensing portion 300 can be electrically connected to the sensing line SL by a sampling switch SW_sam. The sensing portion 300, for example, can include an analog-to-digital converter.

The data driving circuit 130 can drive the sensing line SL, and can detect the characteristic value of the light-emitting element ED disposed on the subpixel SP.

The data driving circuit 130 can make the driving transistor DRT and the light-emitting element ED to be turned-on in a sensing period for detecting the characteristic value of the light-emitting element ED. Alternatively, the data driving circuit 130 can detect the characteristic value of the light-emitting element ED while making only the light-emitting element ED to be turned-on in the sensing period.

As the data driving circuit 130 senses the characteristic value of the light-emitting element ED while making the light-emitting element ED to be turned-on only, it may not be required to control the data voltage Vdata applied to the first node N1 which is the gate node of the driving transistor DRT.

In a subpixel SP structure that the switching transistor SWT and the sensing transistor SENT are driven by the same gate line GL for enhancing the aperture ratio of the subpixel SP, the characteristic value of the light-emitting element ED can be easily sensed.

Figure 4:
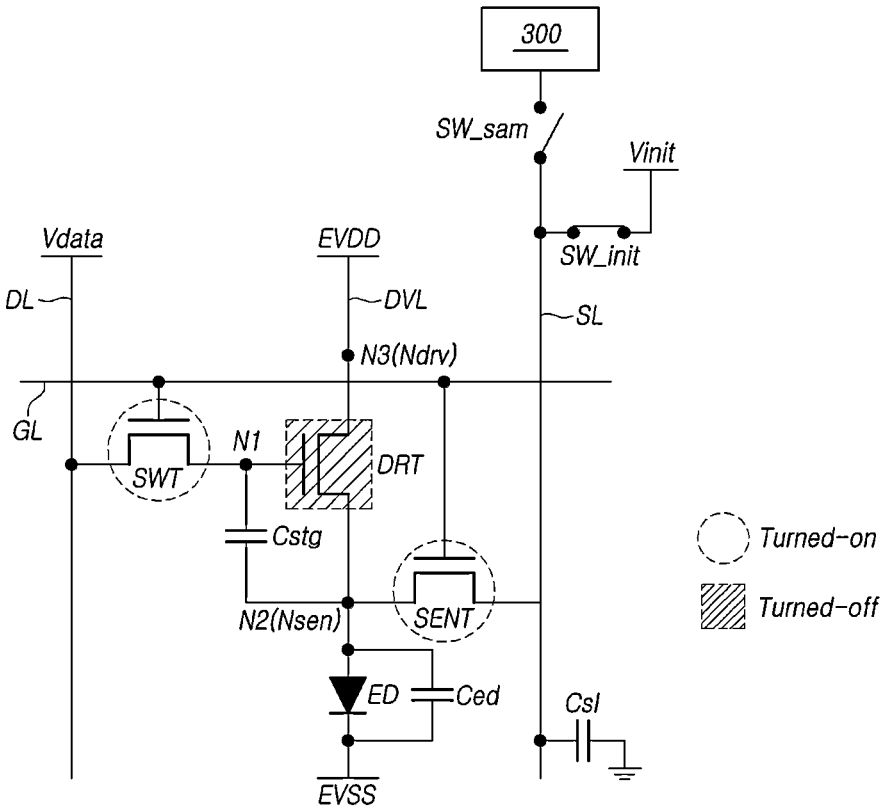
FIGS. 4 to 6 are diagrams illustrating an example of a method sensing a characteristic value of a subpixel included in a display device according to embodiments of the present disclosure.
Figure 4:
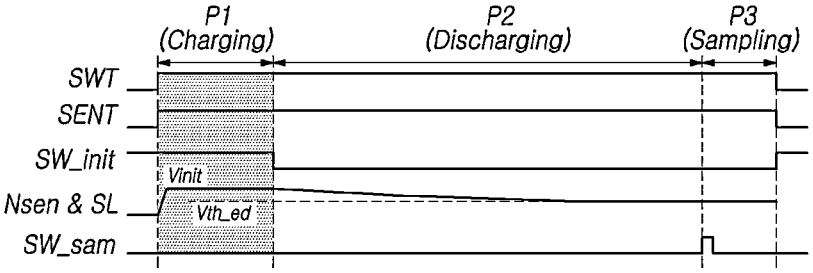
Figure 5:
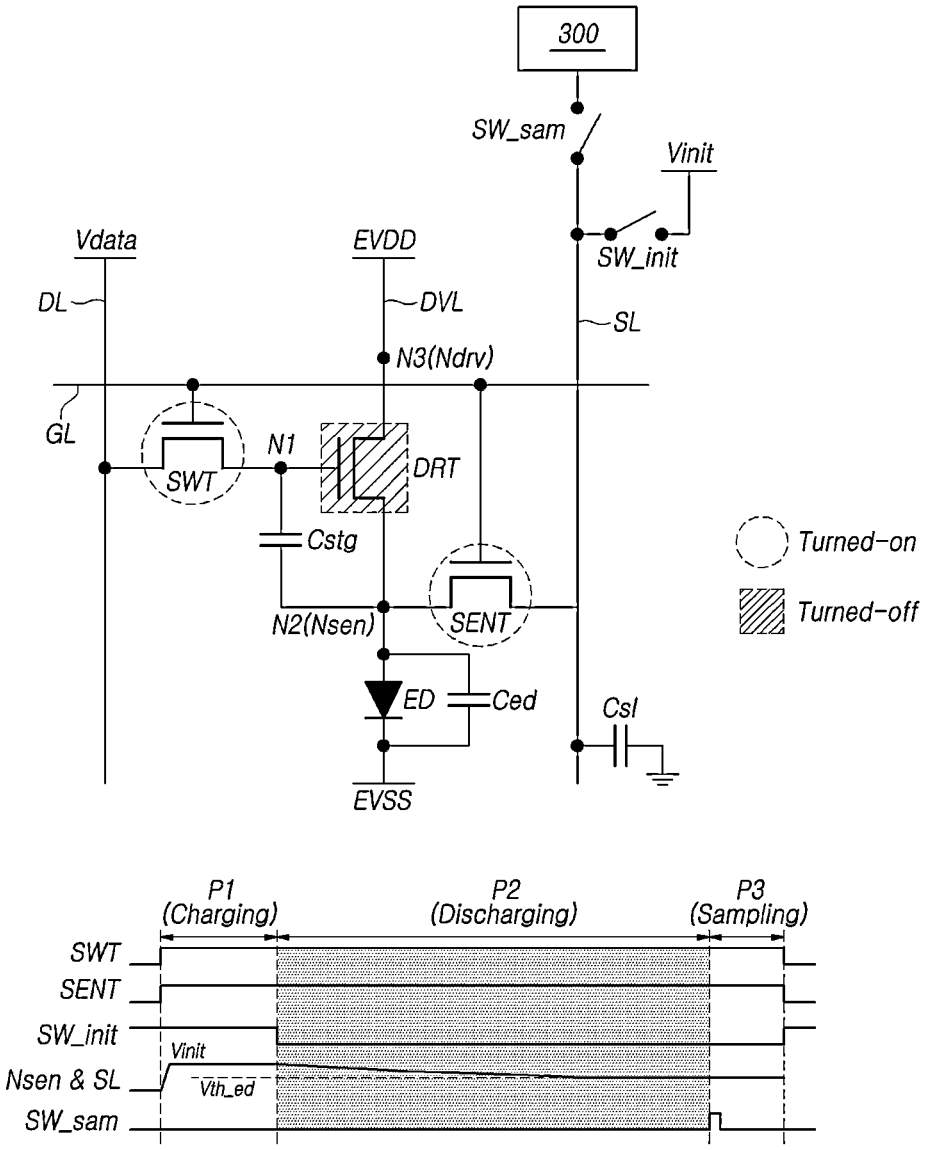
Figure 6:
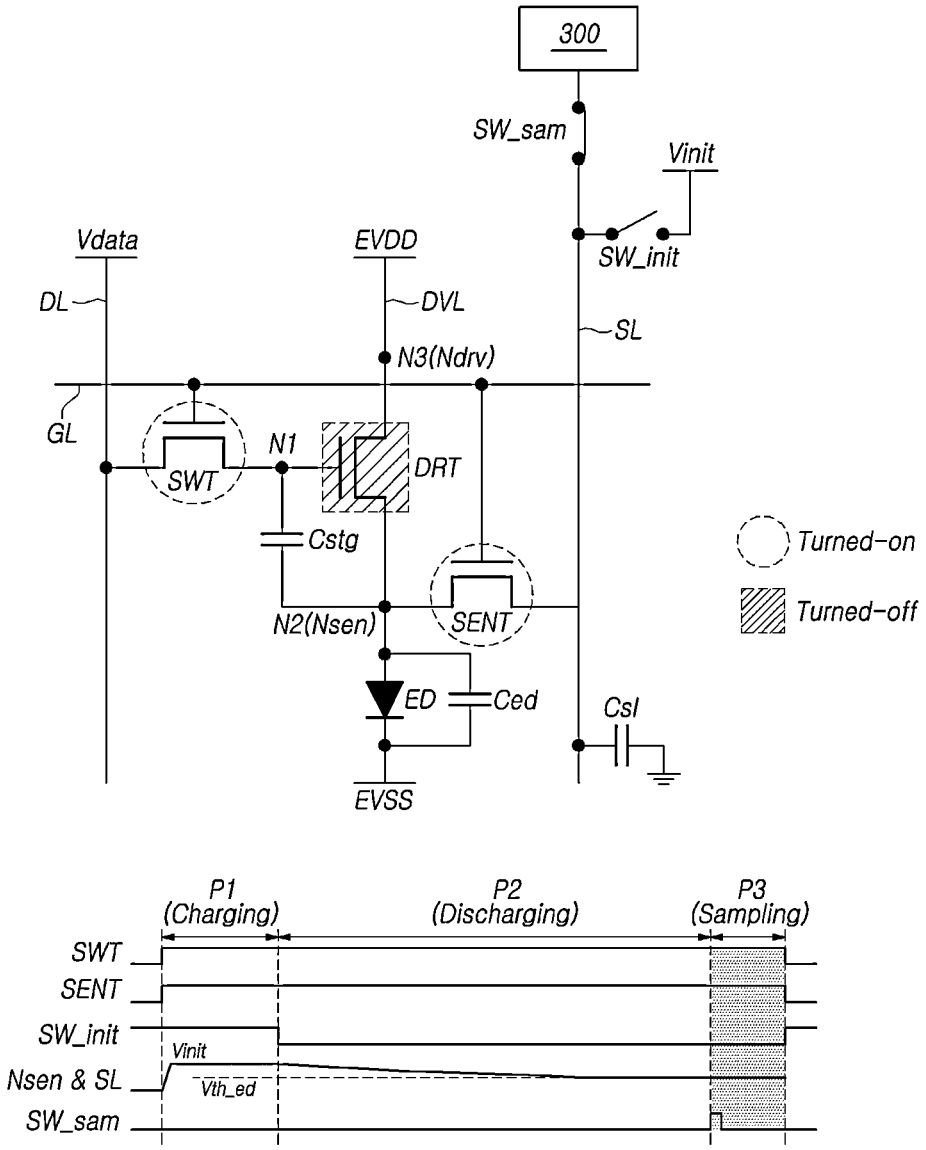

FIGS. 4 to 6 are diagrams illustrating an example of a method sensing a characteristic value of the subpixel SP included in the display device 100 according to embodiments of the present disclosure.

Referring to FIG. 4, it illustrates an example of a driving state of the subpixel SP in a first period P1 of the sensing period. The first period P1 of the sensing period, for example, can be referred as "a charging period".

The scan signal of the turned-on level can be applied through the gate line GL in the first period P1 of the sensing period. As the scan signal of the turned-on level is applied, the switching transistor SWT and the sensing transistor SENT can become a turned-on state.

The switching transistor SWT and the sensing transistor SENT can maintain the turned-on state during the sensing period.

A voltage may not be supplied to the data line DL in the first period P1 of the sensing period. Alternatively, the data voltage Vdata of a low level can be supplied to the data line DL in the first period P1 of the sensing period. The data voltage Vdata of the low level, for example, can mean a voltage of a level which doesn't make the driving transistor DRT to be turned-on.

The driving transistor DRT can be a turned-off state in the first period P1 of the sensing period. The driving transistor DRT can maintain the turned-off state during the sensing period.

The initialization voltage control switch SW_init can become a turned-on state in the first period P1 of the sensing period. As the initialization voltage control switch SW_init becomes the turned-on state, the initialization voltage Vinit can be supplied to the sensing line SL.

As the sensing transistor SENT is the turned-on state, the initialization voltage Vinit can be supplied to the second node N2. In the present disclosure, the second node N2 can be referred as a sensing node Nsen.

The initialization voltage Vinit supplied to the sensing node Nsen can be a voltage greater than the threshold voltage Vth_ed of the light-emitting element ED disposed on the subpixel SP.

Thus, the light-emitting element ED can become a turned-on state in the first period P1 of the sensing period. The light-emitting element ED can emit a light during the first period P1 of the sensing period.

Referring to FIG. 5, a previous driving for detecting the characteristic value of the light-emitting element ED can be performed in a second period P2 after the first period P1 of the sensing period. The second period P2 of the sensing period, for example, can be referred as "a discharging period".

The initialization voltage control switch SW_init can be a turned-off state in the second period P2 of the sensing period. A supply of the initialization voltage Vinit to the sensing line SL can be stopped. The sensing line SL and the sensing node Nsen can be floated.

As the sensing line SL is floated, a charge amount charged in a sensing line capacitor Csl can be reduced according to a current flowing to the light-emitting element ED and a light-emitting element capacitor Ced in the second period P2 of the sensing period. Thus, a voltage of the sensing node Nsen can be reduced gradually (or slowly).

The voltage of the sensing node Nsen can be reduced until it is same as the threshold voltage Vth_ed of the light-emitting element ED. When a certain time elapses in the second period P2 of the sensing period, the voltage of the sensing node Nsen can become the same as the threshold voltage Vth_ed of the light-emitting element ED.

The light-emitting element ED, from the turned-on state, according to the voltage of the sensing node Nsen becomes the same as the threshold voltage Vth_ed of the light-emitting element ED, can become a turned-off state.

Referring to FIG. 6, a third period P3 of the sensing period can be referred as "a sampling period".

The sampling switch SW_sam can become a turned-on state in the third period of the sensing period.

As the sampling switch SW_sam becomes the turned-on state, the sensing portion 300 and the sensing line SL can be electrically connected. The sensing portion 300 can detect a sensing voltage Vsen of the sensing node Nsen through the sensing line SL. The threshold voltage Vth_ed of the light-emitting element ED disposed on the subpixel SP can be checked according to the sensing voltage Vsen detected by the sensing portion 300.

A compensation voltage configured based on the threshold voltage Vth_ed of the light-emitting element ED can be supplied to the corresponding subpixel SP when a display is driven. For example, the threshold voltage Vth_ed of the light-emitting element ED can be compared with an initial value, and the compensation voltage according to a result of a comparison can be supplied to the subpixel SP. Alternatively, the compensation voltage configured according to variation of the threshold voltage Vth_ed between the light-emitting element ED disposed on the subpixels SP can be supplied to the subpixel SP.

Such as described above, by methods for applying a voltage to the sensing node Nsen directly through the sensing line SL and detecting the sensing voltage Vsen of the sensing node Nsen directly, even in the case that the switching transistor SWT and the sensing transistor SENT are driven by the same gate line GL, the characteristic value of the light-emitting element ED can be easily sensed.

Furthermore, embodiments of the present disclosure can provide methods to implement the sensing portion 300 easily by lowering the sensing voltage Vsen before sensing the sensing voltage Vsen of the sensing node Nsen.

FIGS. 7, 8, 9A, 9B and 10 are diagrams illustrating another example of a method sensing a characteristic value of the subpixel SP included in the display device 100 according to embodiments of the present disclosure.

Figure 7:
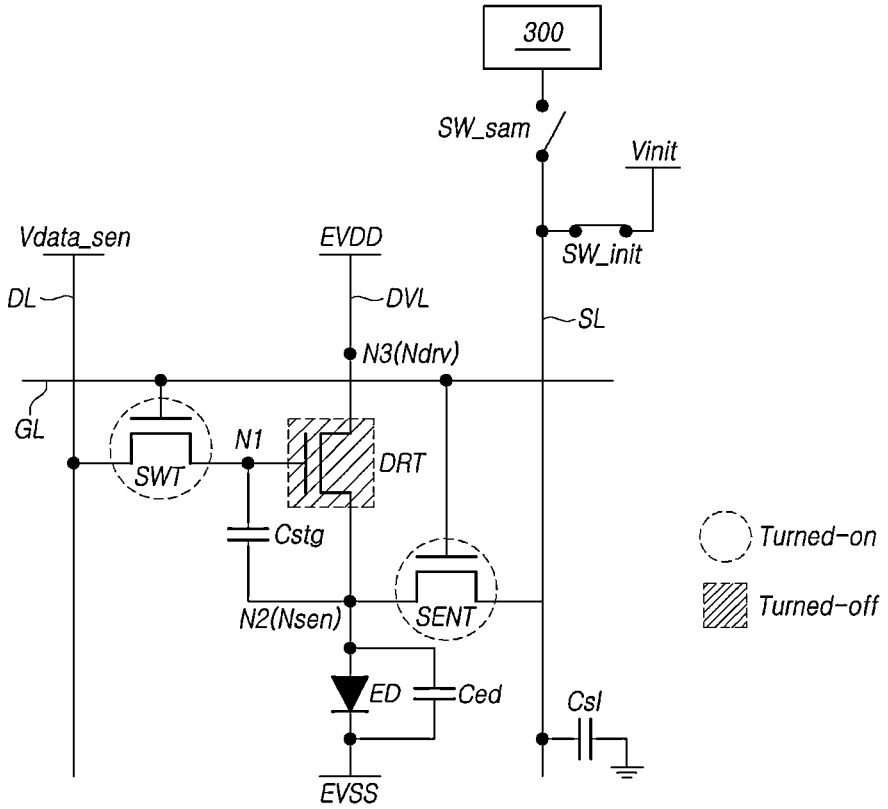
FIGS. 7, 8, 9A, 9B and 10 are diagrams illustrating another example of a method sensing a characteristic value of a subpixel included in a display device according to embodiments of the present disclosure.
Figure 7:
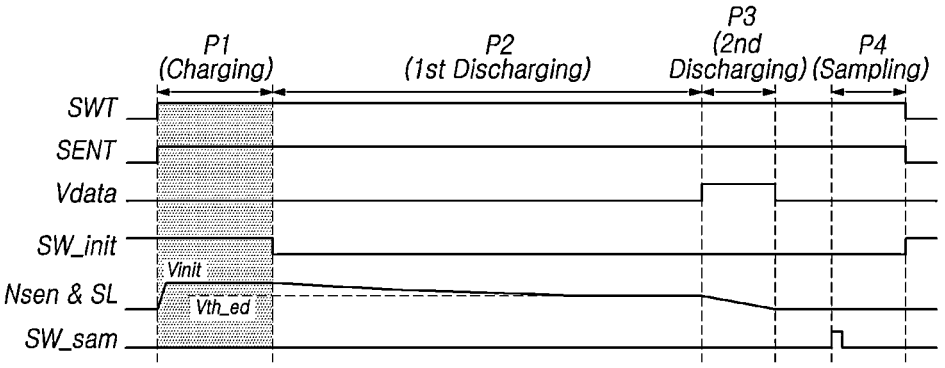

Referring to FIG. 7, the scan signal of the turned-on level can be supplied through the gate line GL in a first period P1 of the sensing period. The switching transistor SWT and the sensing transistor SENT can become the turned-on state in the first period P1 of the sensing period. The switching transistor SWT and the sensing transistor SENT can maintain the turned-on state during the sensing period.

A sensing data voltage Vdata_sen can be supplied to the data line DL in the first period P1 of the sensing period. The sensing data voltage Vdata_sen can be a voltage which doesn't make the driving transistor DRT to be turned-on. Furthermore, the sensing data voltage Vdata_sen can be a voltage lower than the initialization voltage Vinit described below.

In some cases, it can be a state that the sensing data voltage Vdata_sen isn't supplied to the data line DL in the first period P1 of the sensing period.

The driving transistor DRT can be the turned-off state in the first period P1 of the sensing period.

The initialization voltage control switch SW_init can become the turned-on state in the first period P1 of the sensing period. The initialization voltage Vinit can be supplied to the sensing node Nsen through the sensing line SL.

The initialization voltage Vinit can be a voltage greater than the threshold voltage Vth_ed of the light-emitting element ED. The light-emitting element ED can become the turned-on state in the first period P1 of the sensing period.

Figure 8:
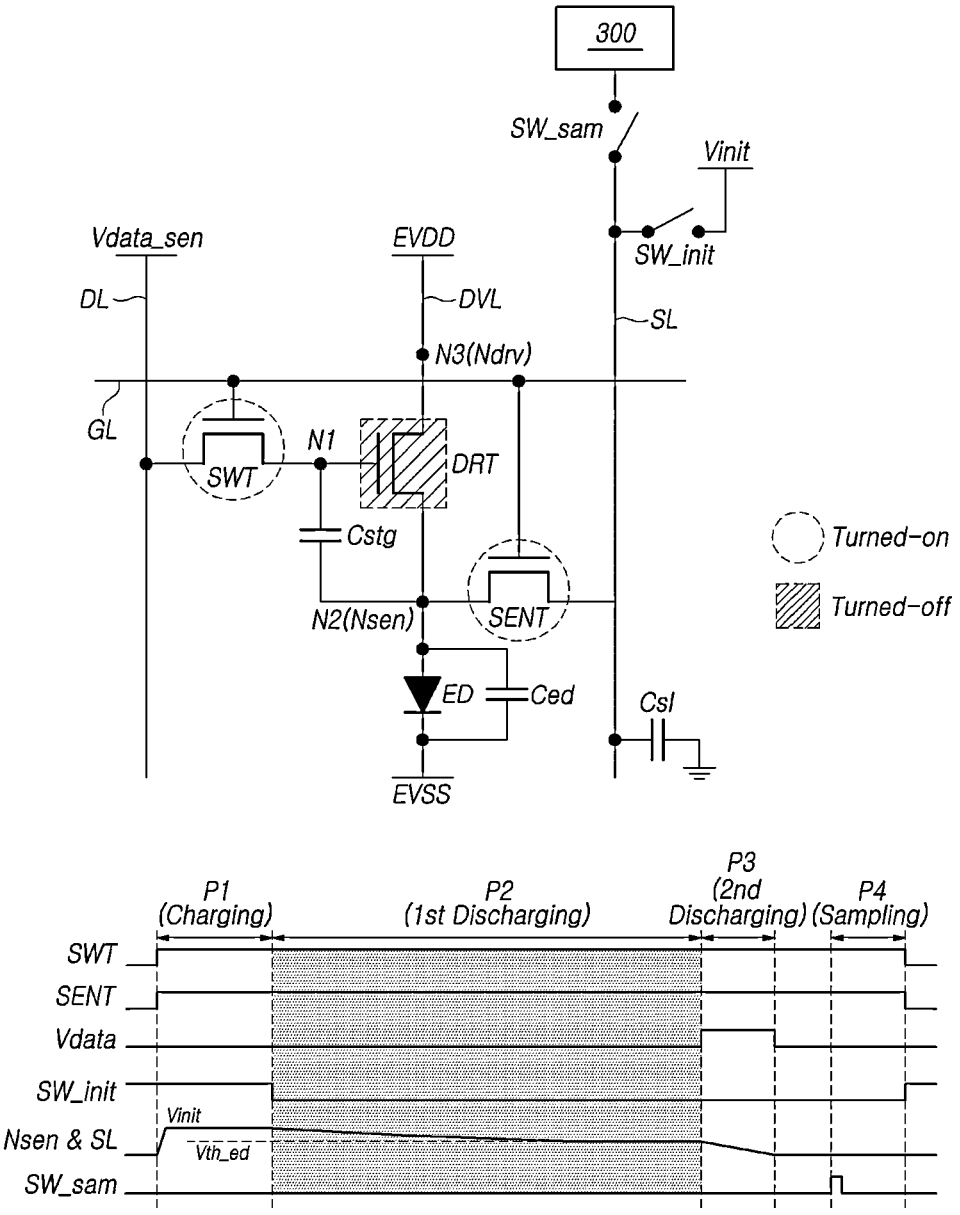

Referring to FIG. 8, a second period P2 of the sensing period can be referred as "a first discharging period".

The initialization voltage control switch SW_init can become the turned-off state in the second period P2 of the sensing period.

In a state that a supply of the initialization voltage Vinit to the sensing line SL is stopped, according to a current supplied to the light-emitting element ED, a charge amount charged in the sensing line capacitor Csl of the sensing line SL can be reduced.

A voltage of the sensing node Nsen can be gradually reduced. The voltage of the sensing node Nsen can become same as the threshold voltage Vth_ed of the light-emitting element ED.

The light-emitting element ED can be changed from the turned-on state to the turned-off state as the voltage of the sensing node Nsen is reduced.

After sufficient time for that the voltage of the sensing node Nsen becomes same as the threshold voltage Vth_ed of the light-emitting element ED elapses, a driving for lowering the voltage of the sensing node Nsen additionally can be performed.

Figure 9A:
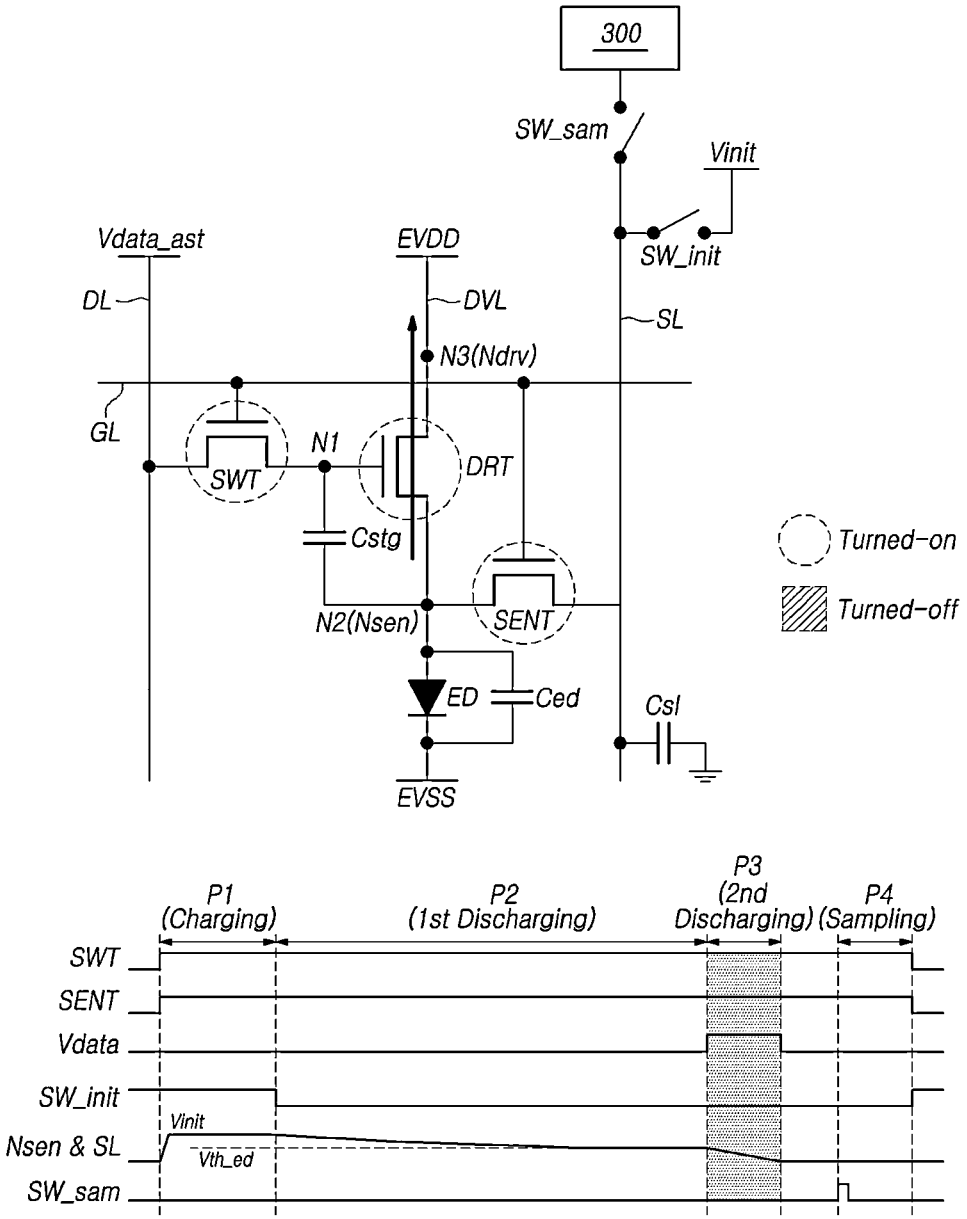

Referring to FIG. 9A, a third period P3 of the sensing period can be referred as "a second discharging period".

An auxiliary data voltage Vdata_ast can be supplied through the data line DL in the third period P3 of the sensing period.

The auxiliary data voltage Vdata_ast can be a voltage of a level that makes the driving transistor DRT to be turned-on. For example, the auxiliary data voltage Vdata_ast can be a voltage of a level that makes the driving transistor DRT to be turned-on so that a current according to a voltage of the sensing node Nsen can be discharged through the driving transistor DRT.

The auxiliary data voltage Vdata_ast can be a voltage lower than the initialization voltage Vinit. The auxiliary data voltage Vdata_ast can be a voltage lower than the threshold voltage Vth_ed of the light-emitting element ED.

In the third period P3 of the sensing period, a level of the first driving voltage EVDD can be different from a level of the first driving voltage EVDD when the display is driven.

For example, the first driving voltage EVDD can be a voltage lower than the auxiliary data voltage Vdata_ast.

Figure 9B:
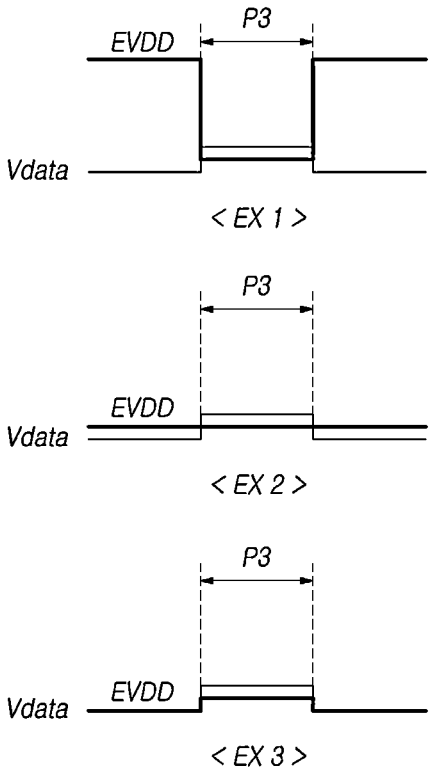

Referring to FIG. 9B, such as <EX 1>, the first driving voltage EVDD is maintaining a state of a high potential, thereafter can be changed to a voltage lower than the auxiliary data voltage Vdata_ast in the third period P3.

Alternatively, such as <EX 2>, the first driving voltage EVDD can be maintained as a voltage lower than the auxiliary data voltage Vdata_ast regardless of a state of the driving transistor DRT or the data voltage Vdata supplied to the data line DL during the sensing period.

Alternatively, such as <EX 3>, the first driving voltage EVDD is maintaining a state of a low potential or isn't supplied to the driving voltage line DVL, thereafter can be changed to a voltage lower than the auxiliary data voltage Vdata_ast in the third period P3.

A level of the first driving voltage EVDD can be various in a period other than the third period P3. And the first driving voltage EVDD can be changed to a voltage configured to be lower than the auxiliary data voltage Vdata_ast so that a current of a certain amount can be discharged through the driving transistor DRT in the third period P3.

A voltage of a driving node Ndrv that the driving transistor DRT and the driving voltage line DVL are electrically connected can be lower than the auxiliary data voltage Vdata_ast in the third period P3. The voltage of the driving node Ndrv can be lower than the voltage of the sensing node Nsen.

Thus, the driving transistor DRT can become the turned-on state in the third period P3 of the sensing period, and a current can be discharged through the driving transistor DRT. And the voltage of the sensing node Nsen can be lowered.

In order to ensure that the current discharged through the driving transistor DRT is constant for each subpixel SP, the auxiliary data voltage Vdata_ast supplied to the subpixel SP can be different.

For example, the threshold voltage or the mobility which are characteristic values of the driving transistor DRT can be different for each subpixel SP.

In this case, if the auxiliary data voltage Vdata_ast is supplied to the subpixel SP as same, a current discharged by the driving transistor DRT can be different for each subpixel SP.

The auxiliary data voltage Vdata_ast which variation of the characteristic value of the driving transistor DRT is compensated can be supplied to each subpixel SP so that the current discharge by the driving transistor DRT become same.

The auxiliary data voltage Vdata_ast supplied to a subpixel SP where a different driving transistor DRT is disposed can be different. And a degree that a voltage of the sensing node Nsen is lowered can become same in each subpixel SP.

The threshold voltage Vth_ed or variation of the threshold voltage Vth_ed of the light-emitting element ED disposed on the subpixel SP can be accurately sensed based on the sensing voltage Vsen detected after the voltage of the sensing node Nsen is lowered.

As a current is discharged by turning-on the driving transistor DRT in the third period P3 of the sensing period, a length of the third period P3 which is the second discharging period can be smaller than a length of the second period P2 which is the first discharging period.

A degree that the voltage of the sensing node Nsen is lowered in the third period P3 of the sensing period can be greater than a degree that the voltage of the sensing node Nsen is lowered in the second period P2 of the sensing period.

As making the voltage of the sensing node Nsen to be lowered through the third period P3 of the sensing period, the sensing voltage Vsen of the sensing node Nsen detected by the sensing portion 300 later can be lowered.

Figure 10:
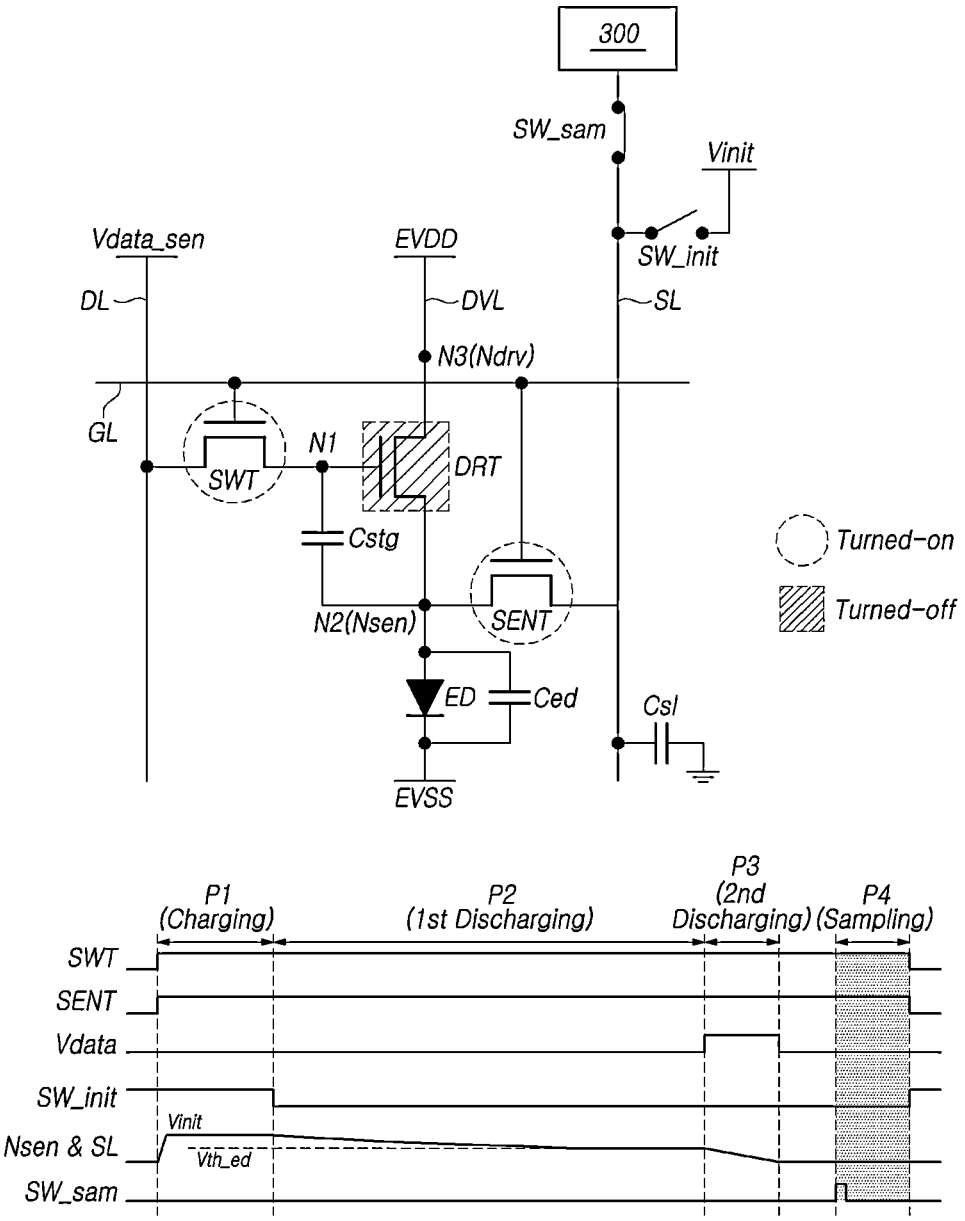

Referring to FIG. 10, a fourth period P4 of the sensing period can be referred to as "a sampling period".

The sensing data voltage Vdata_sen can be supplied to the data line DL in the fourth period P4 of the sensing period. Thus, the driving transistor DRT can become the turned-off state.

The sampling switch SW_sam can become the turned-on state in the fourth period P4 of the sensing period.

The sensing portion 300 can detect the sensing voltage Vsen of the sensing node Nsen through the sensing line SL.

As it is a state that the voltage of the sensing node Nsen is lowered through the third period P3 which is the second discharging period, the sensing voltage Vsen detected by the sensing portion 300 can be a voltage lower than the threshold voltage Vth_ed of the light-emitting element ED.

Thus, the sensing of the characteristic value of the light-emitting element ED can be performed without adding an analog-to-digital converter for sensing high threshold voltage Vth_ed of the light-emitting element ED.

And, for example, the threshold voltage Vth_ed of the light-emitting element ED can be calculated based on an amount of a current discharged in the third period P3.

Alternatively, by comparing the sensing voltage Vsen sensed in the fourth period P4, variation between the threshold voltages Vth_ed of the light-emitting elements ED disposed on the subpixels SP can be checked.

Thus, the characteristic value of the light-emitting element ED can be accurately detected while implementing the sensing portion 300 easily by lowering the sensing voltage Vsen sensed by the sensing portion 300.

Furthermore, methods sensing the characteristic value of the light-emitting element ED according to embodiments of the present disclosure can be applied to a structure that two or more subpixels SP share the sensing line SL.

Figure 11:
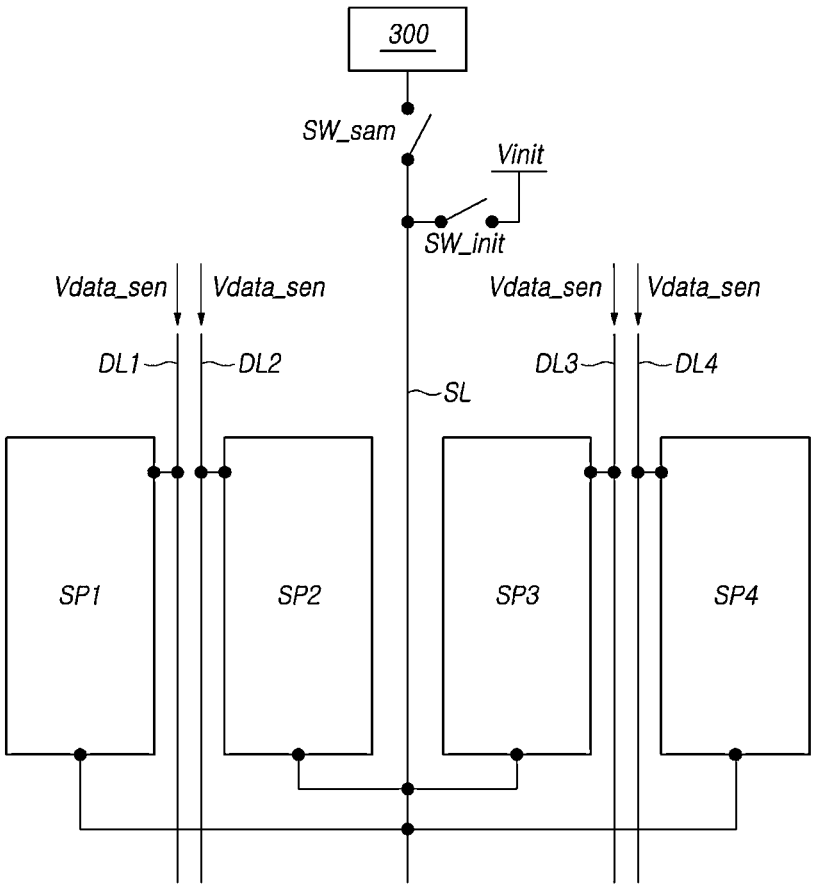
FIGS. 11 and 12 are diagrams illustrating another example of a method sensing a characteristic value of a subpixel included in a display device according to embodiments of the present disclosure.
Figure 12:
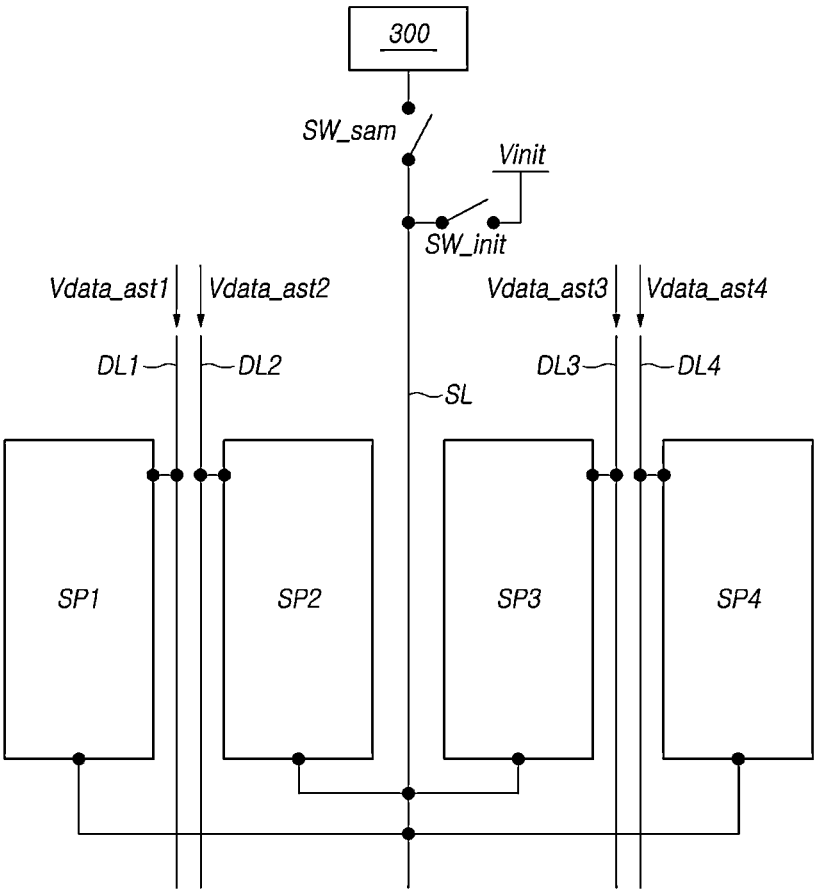

FIGS. 11 and 12 are diagrams illustrating another example of a method sensing a characteristic value of the subpixel SP included in the display device 100 according to embodiments of the present disclosure.

Referring to FIG. 11, for example, four subpixels SP can be driven by the same gate line GL. The four subpixels SP can be driven by different data lines DL.

The four subpixels SP can be electrically connected to one sensing line SL.

As the four subpixels SP are driven by the same gate line GL, when sensing the characteristic value of the light-emitting element ED by a sensing method described above, an average value of the characteristic values of the light-emitting elements ED disposed on the four subpixels SP can be detected through the sensing line SL.

In this case, a compensation value for compensating variation of the characteristic values of the light-emitting elements ED disposed on the four subpixels SP can be calculated based on the average value detected. Thus, variation of the characteristic values of the light-emitting elements ED can be compensated while reducing a sensing time.

Alternatively, the characteristic values of the light-emitting elements ED disposed on each of the four subpixels SP can be calculated based on the average value detected and the driving times of each of the four subpixels SP.

For example, in a case that the driving time of a first subpixel SP1 is greater than the driving times of a second subpixel SP2, a third subpixel SP3 and a fourth subpixel SP4, the characteristic values of the light-emitting elements ED disposed on each subpixels SP can be calculated based on the average value detected and a ratio of the driving time of each subpixels SP.

The driving time of each subpixels SP can be a value corresponding to a total summation of the data voltage Vdata supplied to each subpixels SP during a driving period of the display device 100.

Such as described above, as the characteristic values of the light-emitting elements ED disposed on two or more subpixels SP are detected through the sensing line SL, variation of the characteristic values of the light-emitting elements ED can be compensated while reducing the sensing time. And as the compensation value is configured considering the driving time of each subpixels SP, an accuracy of a compensation based on the average value detected can be enhanced.

Furthermore, in the case that the characteristic values of the light-emitting elements ED are detected from the two or more subpixels SP, the characteristic values of the light-emitting elements ED can be detected while lowering the sensing voltage Vsen of the sensing node Nsen through the first discharging period and the second discharging period.

In this case, different auxiliary data voltages Vdata_ast can be supplied considering to the characteristic values of the driving transistors DRT disposed on each subpixels SP in the second discharging period.

For example, referring to FIG. 12, a first auxiliary data voltage Vdata_ast1 can be supplied to the first subpixel SP1 in the second discharging period of the sensing period detecting the characteristic values of the light-emitting elements ED.

The first auxiliary data voltage Vdata_ast1 can be a voltage configured considering a current to be discharged through the driving transistor DRT for falling the voltage of the sensing node Nsen and the characteristic value of the driving transistor DRT.

Likewise, a second auxiliary data voltage Vdata_ast2, a third auxiliary data voltage Vdata_ast3 and a fourth auxiliary data voltage Vdata_ast4 can be voltages reflecting the characteristic values of the driving transistors DRT disposed on the second subpixel SP2, the third subpixel SP3 and the fourth subpixel SP4.

Such as described above, as compensation values according to variation of the characteristic values of the driving transistor DRT are reflected to the auxiliary data voltages Vdata_ast for making the driving transistors DRT to be turned-on in the second discharging period, currents of same amount can be discharged for each subpixels SP. Thus, an accuracy of the sensing can be maintained while reducing the sensing voltage Vsen after the second discharging period.

According to embodiments of the present disclosure described above, the characteristic values of the light-emitting element ED can be detected by supplying the initialization voltage Vinit to the sensing node Nsen between the driving transistor DRT and the light-emitting element ED directly and detecting the sensing voltage Vsen of the sensing node Nsen.

Thus, in a structure that the switching transistor SWT and the sensing transistor SENT disposed on the subpixel SP are driven by the same gate line GL, the characteristic value of the light-emitting element ED can be sensed.

Furthermore, as the current is discharged by making the driving transistor DRT to be turned-on after that the voltage of the sensing node Nsen becomes a state to be same as the threshold voltage Vth_ed of the light-emitting element ED, the voltage of the sensing node Nsen can be lowered.

As the sensing is performed while falling the voltage of the sensing node Nsen, variation of the characteristic value of the light-emitting element ED can be compensated while implementing easily the sensing portion 300 for sensing the high threshold voltage Vth_ed of the light-emitting element ED.

Furthermore, embodiments of the present disclosure can be applied to distinguish a normal light-emitting element ED having the characteristic value meeting a reference value and a defective light-emitting element ED having the characteristic value deviating from the reference value much among the light-emitting elements ED disposed on the subpixels SP.

It will be apparent to those skilled in the art that various modifications and variations can be made in the driving circuit and the display device of the present disclosure without departing from the technical idea or scope of the disclosure. Thus, it is intended that the present disclosure cover the modifications and variations of this disclosure provided they come within the scope of the appended claims and their equivalents.

What is claimed is:

1. A display device, comprising:

a plurality of subpixels disposed in a display panel;

a plurality of sensing lines electrically connected to at least one of the plurality of subpixels; and a driving circuit configured to drive the plurality of sensing lines, wherein each of the plurality of subpixels comprises, a light-emitting element;

a driving transistor configured to drive the light-emitting element; and a sensing transistor electrically connected between a sensing node which the light-emitting element and the driving transistor are electrically connected to each other and the sensing line, wherein the display device is configured in that, during a sensing period for detecting a characteristic value of the light-emitting element, in a first period, the sensing transistor becomes a turned-on state and an initialization voltage is supplied through the sensing line, in a second period, a supply of the initialization voltage to the sensing line is stopped, in a third period, the driving transistor becomes a turned-on state, and in a fourth period, the driving transistor is a turned-off state when a sensing voltage of the sensing node is detected.

2. The display device of claim 1, wherein, in the third period, an auxiliary data voltage is supplied to a gate node of the driving transistor, and the auxiliary data voltage is smaller than the initialization voltage.

3. The display device of claim 2, wherein the auxiliary data voltage supplied to a subpixel where a first driving transistor is disposed among the plurality of subpixels is different from the auxiliary data voltage supplied to a subpixel where a second driving transistor is disposed among the plurality of subpixels.

4. The display device of claim 2, wherein, in the third period, a voltage of a driving node which the driving transistor is electrically connected to a driving voltage line is smaller than the auxiliary data voltage.

5. The display device of claim 2, wherein, in the first period and the second period, a sensing data voltage is supplied to the gate node of the driving transistor, and the sensing data voltage is smaller than the auxiliary data voltage.

6. The display device of claim 1, wherein a length of the third period is smaller than a length of the second period.

7. The display device of claim 1, wherein a degree that a voltage of the sensing node is changed in the third period is greater than a degree that a voltage of the sensing node is changed in the second period.

8. The display device of claim 1, wherein a voltage of the sensing node decreases in the third period.

9. The display device of claim 1, wherein the driving transistor is a turned-off state in the first period and the second period.

10. The display device of claim 1, wherein the light-emitting element is a turned-on state in at least a part of the first period and the second period, and is a turned-off state in the third period.

11. The display device of claim 1, wherein the sensing line is floated in the second period.

12. The display device of claim 1, wherein the sensing transistor maintains a turned-on state during the sensing period.

13. The display device of claim 1, wherein the each of the plurality of subpixels further comprises a switching transistor electrically connected to a gate node of the driving transistor, and the switching transistor is a turned-on state during a period that the sensing transistor is a turned-on state.

14. The display device of claim 1, wherein the initialization voltage is greater than a threshold voltage of the light-emitting element.

15. The display device of claim 1, wherein the sensing voltage is simultaneously detected from two or more subpixels electrically connected to the sensing line among the plurality of subpixels, a compensation voltage configured based on the sensing voltage is supplied to the two or more subpixels, and the compensation voltage supplied to a first subpixel of the two or more subpixels is different from the compensation voltage supplied to a second subpixel of the two or more subpixels.

16. A display device, comprising:

a plurality of subpixels disposed in a display panel;

a plurality of sensing lines electrically connected to at least one of the plurality of subpixels; and a driving circuit configured to drive the plurality of sensing lines, wherein each of the plurality of subpixels comprises, a light-emitting element;

a driving transistor configured to drive the light-emitting element; and a sensing transistor electrically connected between a sensing node which the light-emitting element and the driving transistor are electrically connected to each other and the sensing line, wherein the display device is configured in that, during a sensing period for detecting a characteristic value of the light-emitting element, an initialization voltage is supplied to the sensing node and a sensing voltage of the sensing node is detected after a predetermined period, the driving transistor is a turned-off state in at least a part period of the sensing period, and the driving transistor is a turned-off state when the sensing voltage of the sensing node is detected.

17. The display device of claim 16, wherein the driving transistor becomes a turned-on state in a part period of the predetermined period.

18. The display device of claim 17, wherein the driving transistor becomes a turned-off state before the sensing voltage of the sensing node is detected.

19. The display device of claim 17, wherein the light-emitting element is a turned-off state in a period that the driving transistor is a turned-on state.

20. A driving circuit, comprising:

a driving circuit configured to:

control a voltage output to a data line electrically connected to a subpixel; and control a voltage output to a sensing line electrically connected to the subpixel, wherein the driving circuit is electrically connected to the sensing line, wherein, during a sensing period for detecting a characteristic value of a light-emitting element disposed on the subpixel, in a first period, the driving circuit is configured to output a sensing data voltage to the data line, and to output an initialization voltage to the sensing line, in a second period, the driving circuit is configured to stop an output of the initialization voltage, in a third period, the driving circuit is configured to output an auxiliary data voltage greater than the sensing data voltage and smaller than the initialization voltage to the data line, and in a fourth period, the driving circuit is configured to detect a sensing voltage through the sensing line.

* * * * *